US006112536A

United States Patent [19]

Hansen

[11] Patent Number: 6,112,536

[45] Date of Patent: Sep. 5, 2000

[54] CONVERTIBLE CONDENSATE DRAIN PAN

[75] Inventor: William G. Hansen, Adams, Tenn.

[73] Assignee: American Standard Inc., Piscataway, N.J.

[21] Appl. No.: 09/303,872

[22] Filed: May 3, 1999

[51] Int. Cl.[7] ..... F25D 21/14

[52] U.S. Cl. ..... 62/285

[58] Field of Search ..... 62/285, 286, 272

[56] References Cited

U.S. PATENT DOCUMENTS

| | | | |
|---|---|---|---|
| 3,102,654 | 9/1963 | Millman et al. . | |
| 4,970,875 | 11/1990 | Kim | 62/272 |
| 5,715,697 | 2/1998 | Rust, Jr. et al. | 62/286 |
| 5,787,721 | 8/1998 | Fromm et al. | 62/285 |
| 5,904,053 | 5/1999 | Polk et al. | 62/285 |
| 5,966,959 | 10/1999 | Stewart | 62/285 |

FOREIGN PATENT DOCUMENTS

| | | | |
|---|---|---|---|
| 52-52455 | 6/1977 | Japan | 62/285 |
| 52-76755 | 6/1977 | Japan | 62/285 |

*Primary Examiner*—William Doerrler
*Assistant Examiner*—Melvin Jones
*Attorney, Agent, or Firm*—William J. Beres; William O'Driscoll; Peter D. Ferguson

[57] ABSTRACT

A condensate drain pan. The drain pan comprises a frame supporting a surface; a side outlet in the frame proximal a high point; and a bottom outlet in the surface proximal a low point. The surface is sloped so that the first side drains to the side outlet; the surface is sloped so that the second side drains to the bottom outlet; and the surface is sloped from the high point to the low point.

26 Claims, 2 Drawing Sheets

CONVERTIBLE CONDENSATE DRAIN PAN

BACKGROUND OF THE INVENTION

The present invention is directed to a condensate drain pan for use under the heat exchange coil of an HVAC or refrigeration system. More specifically, the condensate drain pan is multi-functional in that it includes a bottom outlet and a side outlet and in that either outlet can be used on either end of an air conditioning cabinet.

In recent years, the air conditioning industry has had a heightened awareness of indoor air quality, particularly relating to the potential health concerns deriving from microbial growth in standing condensate. This standing condensate remains in the drain pans during the air conditioning unit's off cycle, and may be subsequently transported to an occupied space by way of the indoor air stream. For this reason, the air conditioning industry has recognized the need for a periodic cleaning of drain pans. Drain pans are positioned under a condensing heat exchange coil to collect the condensate as that condensate condenses and drips off the coil.

Typical past industry practice has provided a flat condensate pan with condensate connections at only one end of the drain pan. In installing such drain pans, particularly in retrofit applications, it is not uncommon for the air conditioning unit to be improperly leveled during installation. If an air conditioning unit is improperly leveled such that the slope of the unit is away from the single drain pan connection, condensate will pool at the end of the drain pan opposite the drain connection. In more extreme cases, condensate will overflow the drain pan resulting in unwanted water in the base of the air conditioning unit and, potentially, in the occupied space and structure. Past solutions to this situation have included (a) removal of the air conditioning unit and re-leveling of the mounting curb at great expense, or (b) if the unit is large enough, providing a connection at either end of the drain pan. In many cases, the problem is simply ignored due to the difficulty in correcting the problem.

Furthermore, access for cleaning of drain pans in the past has typically been through a time consuming removal of the exterior panels of the air conditioning units, followed by an attempt to clean the drain pan through a limited access aperture. As a result, the drain pan was often not cleaned, or was improperly cleaned. In some cases, chemical "pills" to counteract microbial growth have been added to drain pans in lieu of full drainage and proper cleaning.

Industry standards have been under development that make it unacceptable to provide air conditioning unit designs that allow condensate to pool in drain pans. The practical industry response to this has been to provide drain pans with sloped surfaces to ensure complete drainage. However, this assumes that the air conditioning units are properly leveled. With a sloped drain pan there is no longer a way to provide connections on both ends of the drain pan without one end of the drain pan being dysfunctional, thereby eliminating the second solution above and leaving only the solution of incurring the expense of re-leveling the air conditioning unit if the unit is improperly installed.

Regarding bottom condensate connections, it is becoming common practice in the building/roofing industry to eliminate as many roof penetration apertures as possible due to the substantial warranties and potential liabilities associated with roof leaks in that industry. As such, there is a growing preference to bring the condensate disposal piping of the air conditioning unit from the space up through the bottom of the unit to eliminate a roof penetration and a potential leak related liability. Solutions to date have been (a) to route condensate piping out of the side of the unit and back in through the side of the rooftop curb, or (b) to provide both bottom and side outlet connections, requiring whichever outlet connection is not in use to be plugged or capped with a potential for leaks, or (c) to mount the drain pan in an elevated position within an air conditioning unit such that the piping could be routed out either the side or through the base of the unit.

It would be desirable to provide a drain pan which is easily cleanable, which is sloped, which can be installed from either side, and which includes both a bottom outlet and a side outlet.

SUMMARY OF THE INVENTION

It is an object, feature and advantage of the present invention to solve the problems with the prior art condensate drain pans.

It is an object, feature and advantage of the present invention to allow easy relocation of the condensate drain pan such that the drain pan slopes to the lower side of the air conditioning unit after the air conditioning unit has been installed. It is a further object, feature and advantage of the present invention to provide either a bottom outlet or a side outlet and drain connection for that pan.

It is an object, feature and advantage of the present invention to allow an air conditioning installer to have flexibility in routing condensate disposal piping to either side of an air conditioning unit.

It is an object, feature and advantage of the present invention to allow easy removal of a complete drain pan for cleaning of the drain pan externally of an air conditioning unit.

It is an object, feature and advantage of the present invention to provide a one-piece, molded, polymeric condensate drain pan for installation in an air conditioning cabinet for collection and disposal of condensate from cooling coils.

It is an object, feature and advantage of the present invention to provide a condensate drain pan having a compound sloped surface. It is a further object, feature and advantage of the present invention to provide a condensate drain pan with a compound sloped bottom surface that slopes continuously towards a side outlet in side outlet applications, and slopes continuously towards a bottom outlet in bottom outlet applications. It is a further object, feature and advantage of the present invention to eliminate any possibility of standing condensate in the pan.

It is an object, feature and advantage of the present invention to allow a condensate drain pan to be easily converted from a bottom outlet to a side outlet or vice versa without the use of additional piping, joints or increased potential for leakage. It is a further object, feature and advantage of the present invention to provide a condensate drain pan which is convertible from right hand condensate connections in the cabinet to left hand condensate connections in the cabinet to thereby allow flexibility in installation and to allow field compensation for installations that are not properly leveled.

It is an object, feature and advantage of the present invention to provide a condensate drain pan that can be rotated along its longitudinal axis to convert from a side outlet to a bottom outlet or vice versa. It is a further object, feature and advantage of the present invention to provide a condensate drain pan which can be rotated along its lateral axis to convert from one side of a cabinet to another.

It is an object, feature and advantage of the present invention to provide recessed side and/or bottom drain connections to thereby eliminate any extruding part which might be damaged in shipping or handling, or which might prevent easy slide out removal from an air conditioning cabinet.

It is an object, feature and advantage of the present invention to provide a condensate drain pan which is convertible from one side to another to allow effective condensate drainage in installations where the units are not properly leveled and/or to allow for flexible routing of condensate drain disposal piping.

It is an object, feature and advantage of the present invention to provide a drain pan design which eliminates the need to seal the bottom outlet in side outlet applications.

It is an object, feature and advantage of the present invention to provide a drain pan design which eliminates the need to seal the side outlet in bottom outlet applications.

The present invention provides a condensate drain pan. The drain pan comprises a frame supporting a surface where the surface is sloped from a high point to a low point. The drain pan also comprises a side outlet in the frame proximal the high point; and a bottom outlet in the surface proximal the low point. The surface is sloped so that the first side drains to the side outlet; and the surface is sloped so that the second side drains to the bottom outlet.

The present invention also provides a two-sided drain pan. The drain pan comprises a bottom draining side and a side draining side. The bottom draining side includes a bottom sloped face sloping to a first low point, a bottom outlet in the area of the first low point, and a bottom frame arranged around the bottom sloped face. The side draining side includes a side outlet face sloped to a second low point, a side frame arranged about the side outlet face, and a side outlet in the side frame.

The present invention additionally provides a method of manufacturing a condensate drain pan. The method comprises the steps of: forming a two-sided pan having a first side including a first high point and a first low point and a second side including a second low point corresponding to the first high point and a second high point corresponding to the first low point; forming a bottom outlet at the first low point and at the second high point; and forming a side outlet adjacent the second low point and proximal the first high point.

The present invention further provides a method of draining condensate. The method comprises the steps of: providing a two-sided pan wherein the first side includes a bottom outlet and the second side includes a side outlet; rotating the pan in a horizontal plane to switch an existing outlet from a first cabinet side to a second cabinet side; and rotating the pan in a vertical plane to switch between the bottom outlet and the side outlet.

The present invention still further provides a condensate drain pan. The drain pan comprises an integral partition having a horizontal drain side and a vertical drain side; and a frame supporting and operably connected to the partition. The frame has a generally rectangular shape including first and second opposed corners. The first corner of the frame includes a lateral drain aperture in the frame. The partition includes a vertical drain aperture in the partition proximal the second corner. The partition also includes a first face and a second face and is sloped on each face from the lateral drain to the vertical drain.

DETAILED DESCRIPTION OF THE DRAWING

Figure 7:
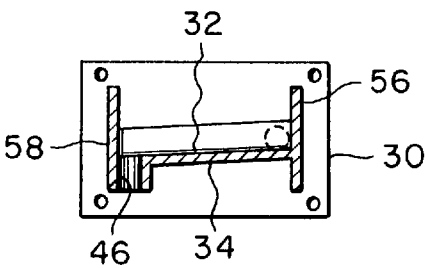
FIG. 7 is an end view of the side outlet side taken along line 7—7 of FIG. 5.

The present invention is directed to a condensate drain pan 10 arranged under a heat exchange coil 12 and catching condensate 14 dripping from the coil 12. Typically, the coil 12 and the drain pan 10 are within a cabinet 16 including a left side wall 18 and a right side wall 20. Either or both of the walls 18, 20 includes an aperture 22 allowing the drain pan 10 to be inserted into the interior 24 of the cabinet 16. A cover plate 26 is attached to the wall 18, 20 to cover the aperture 22 after the drain pan 10 is inserted.

Figure 4:
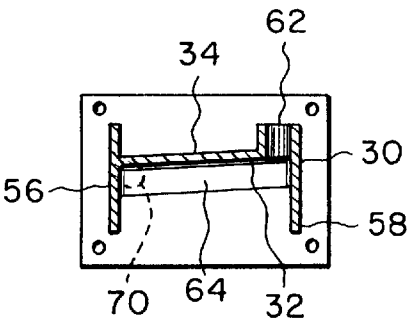
FIG. 4 is an end view of the bottom outlet side taken along lines 4—4 of FIG. 2.
Figure 1:
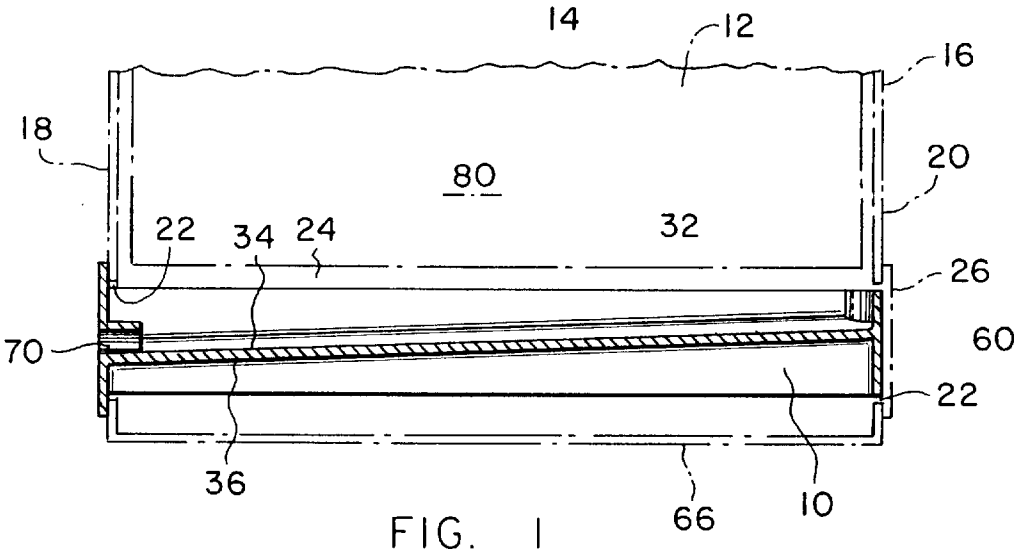
FIG. 1 is a diagram of an air conditioning cabinet, heat exchange coil and drain pan in accordance with the present invention.
Figure 2:
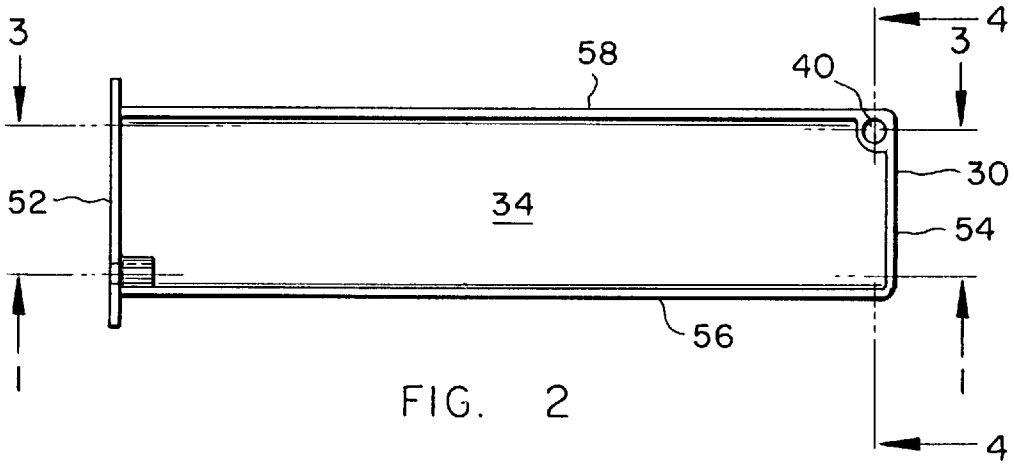
FIG. 2 is a top view of the bottom outlet side of the drain pan taken along lines 2—2 of FIG. 1.
Figure 6:
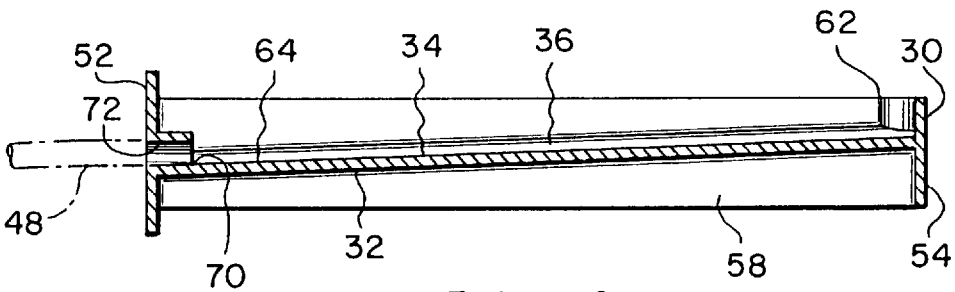
FIG. 6 is a side view of the side outlet side taken along lines 6—6 of FIG. 5.
Figure 3:
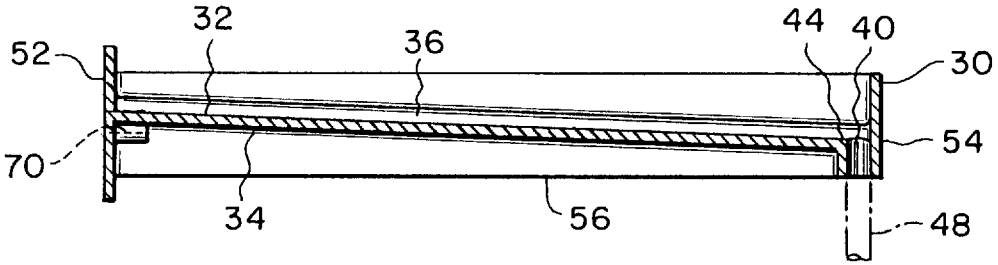
FIG. 3 is a side view of the bottom outlet side taken along lines 3—3 of FIG. 2.
Figure 5:
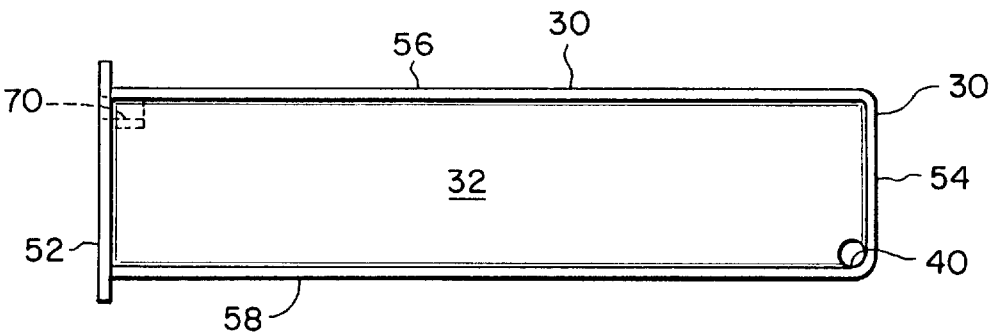
FIG. 5 is a top view of the side outlet side of the drain pan taken along lines 5—5 of FIG. 1.

The drain pan 10 has a frame 30 surrounding and supporting a drain pan surface 32. The drain pan surface 32 has a first face 34 sloped for side outlet application and a second face 36 sloped for bottom outlet applications. FIGS. 2–4 are directed to the features of the bottom outlet application, while FIGS. 5-7 are directed to the features of the side outlet application.

Referring to FIGS. 2-4, the bottom outlet application includes an aperture 40 in the surface 32. The bottom outlet face 36 slopes from a first high point 42 to a first low point 44 to direct condensate to that first low point 44. The bottom outlet aperture 40 is located proximal the first low point 44 so that, upon installation, all condensate is directed to that low point 44 to drain out the aperture 40. The aperture 40 includes a recessed connection portion 46 which does not protrude from the drain pan 10. A conduit 48 may be inserted in the recessed connection 46 to receive condensate collected by the surface 32.

The second face 36 is preferably sloped in two directions such that the surface 36 slopes from a first longitudinal end 52 of the drain pan to a second longitudinal end 54 of the drain pan 10 and also slopes from a first side 56 to a second side 58 of the drain pan. The frame 30 includes the first and second ends 52, 54 and the first and second sides 56, 58.

The drain pan 10 is arranged along a longitudinal axis 60. When the drain pan 10 is rotated in a vertical plane about the longitudinal axis 60, the drain pan 10 can be converted back and forth between the bottom outlet application shown in FIGS. 2–4 and the side outlet application shown in FIGS. 5–7.

The first face 34 is also preferably sloped in two directions. The first face 34 is sloped from a second high point 62 to a second low point 64. The second high point 62 is in a corresponding location with the first low point 44 but on opposite side of the surface 32, while the second low point 64 is in a corresponding location with the first high point 62 but also on opposite sides of the surface 32.

In the side outlet application, the first end wall 52 includes a side outlet aperture 70 proximal the second low point 64. The side outlet face 34 is sloped from the high point 62 near the second end wall 54 to the low point 64 near the first end wall 52 as shown in FIG. 6, and is sloped from the side wall 58 to the low point 64 near the first side wall 56 so that condensate is directed to the aperture 70 in the side wall outlet application. The aperture 70 has a recessed connection 72 which does not protrude from the frame 30. A conduit 48 may be inserted in the recessed connection 72 to collect condensate.

The drain pan 10 is preferably rectangular such that it can be slid out of an aperture 22 for easy cleaning access, but may be in any other suitable shape. The drain pan 10 can be converted from left side 18 application to right side 20 application by removing the drain pan 10 from either side of the cabinet 16, and by reinserting the drain pan 10 in the opposite side of the cabinet 16 with the desired drainage aperture 40, 70 at the desired side wall 18, 20. Basically, the drain pan 10 is converted from left side side outlet applications to right side side outlet application be rotating in a horizontal plane about a vertical axis 80. As noted, the condensate drain pan connections can be converted between side outlet applications to bottom outlet applications by removing the drain pan 10 from the cabinet 16 and rotating the drain pan 10 180° about the longitudinal axis 60.

In the bottom outlet application of FIGS. 2–4, the side outlet aperture 70 is under the surface 32 as indicated by portion 82, thereby eliminating any need to seal the unused aperture 70 from water accumulation or drainage. Further, if the bottom edge 84 of the drain pan 10 is properly sealed to a cabinet base 86, the need to seal the airflow path from the cabinet exterior is also eliminated by a dead end cavity.

Similarly, in the side outlet application shown in FIGS. 5–7, the bottom outlet aperture 40 is at the highest most point 62 diagonally opposite from the side outlet 70, eliminating any need to seal the unused connection 46.

What has been described is a condensate drain pan which is easily removable for cleaning, which is suitable for right and left hand application, and is suitable for bottom and side outlet applications. It will be apparent to a person of ordinary skill in the art that many alterations and modifications are applicable to this drain pan. All such modifications and alterations are intended to fall within the spirit and scope of the claimed invention.

What is desired to be secured for Letters Patent of the United States is set forth in the following claims.

What is claimed is:

1. A condensate drain pan comprising:

a frame supporting a surface, the surface being sloped from a high point to a low point;

a side outlet in the frame proximal the high point;

a bottom outlet in the surface proximal the low point;

the surface being sloped so that the first side drains to the side outlet; and the surface being sloped so that the second side drains to the bottom outlet.

2. The condensate drain of claim 1 wherein the side outlet includes a recessed connection on an exterior side of the frame.

3. The condensate drain of claim 1 wherein the bottom outlet includes a recessed connection on an exterior side of the frame.

4. The condensate drain pan of claim 3 wherein the surface has a double slope.

5. The condensate drain pan of claim 4 wherein the frame and surface comprise a one-piece, molded, polymeric construction.

6. The condensate drain pan of claim 5 wherein the side outlet is exposed to only a single side of the surface.

7. A two-sided drain pan comprising:

a bottom draining side including a bottom sloped face sloping to a first low point, a bottom outlet in the area of the first low point, and a bottom frame arranged around the bottom sloped face;

a side draining side including a side outlet face sloped to a second low point, a side frame arranged about the side outlet face, and a side outlet in the side frame.

8. The drain pan of claim 7 wherein the side frame and the bottom frame are unitary pieces.

9. The drain pan of claim 7 wherein the bottom sloped face and the side outlet face are opposing sides of a unitary piece.

10. The drain pan of claim 9 wherein the bottom outlet is recessed to receive a drain conduit.

11. The drain pan of claim 10 wherein the side outlet is recessed to receive a drain conduit.

12. The drain pan of claim 11 wherein the side outlet is exposed to the side outlet face but is not exposed to the bottom sloped face.

13. A method of manufacturing a condensate drain pan comprising the steps of:

forming a two-sided pan having a first side including a first high point and a first low point and a second side including a second low point corresponding to the first high point and a second high point corresponding to the first low point;

forming a bottom outlet at the first low point and at the second high point; and forming a side outlet adjacent the second low point and proximal the first high point.

14. The method of claim 13 including the further step of sloping the first side from the first high point to the first low point and sloping the second side from the second low point to the second high point.

15. The method of claim 14 wherein the sloping step includes the further step of providing a compound slope on the first and second sides.

16. The method of claim 15 including the further step of recessing the bottom outlet.

17. The method of claim 16 including the further step of recessing the side outlet.

18. A method of draining condensate comprising the steps of:

providing a two-sided pan wherein the first side includes a bottom outlet and the second side includes a side outlet;

rotating the pan in a horizontal plane to switch an existing outlet from a first cabinet side to a second cabinet side; and rotating the pan in a vertical plane to switch between the bottom outlet and the side outlet.

19. The method of claim 18 including the further step of separating the bottom outlet from the side outlet with a sloped face.

20. The method of claim 19 including the further steps of recessing the bottom outlet and recessing the side outlet.

21. The method of claim 20 including the steps of providing effective condensate drainage by rotating the pan in the horizontal and vertical planes until either the bottom outlet or the side outlet is at the lowest position relative to the rest of the pan.

22. A condensate drain pan comprising:

an integral partition having a horizontal drain side and a vertical drain side;

a frame supporting and operably connected to the partition, the frame having a generally rectangular shape including first and second opposed corners, the first corner of the frame including a lateral drain aperture in the frame; and the partition including a vertical drain aperture in the partition proximal the second corner, the partition including a first face and a second face and being sloped on each face from the lateral drain to the vertical drain.

23. The condensate drain pan of claim 22 wherein the lateral drain aperture is open to the horizontal drain side but is not exposed to the vertical drain side.

24. The condensate drain pan of claim 23 wherein the vertical drain includes a recessed external connection.

25. The condensate drain pan of claim 24 wherein the lateral drain aperture includes a recessed external connection.

26. The condensate drain pan of claim 25 wherein the slope on each face is a compound slope.

* * * * *